United States Patent [19]

Suiter

[11] Patent Number: 4,867,816

[45] Date of Patent: Sep. 19, 1989

[54] BOWLING LANE REFINISHING METHOD

[76] Inventor: James R. Suiter, 2030 N. 104th St., Omaha, Nebr. 68134

[21] Appl. No.: 203,617

[22] Filed: Jun. 6, 1988

Related U.S. Application Data

[63] Continuation of Ser. No. 871,318, Jun. 6, 1986, abandoned.

[51] Int. Cl.[4] ..... A63D 1/04; B32B 31/04

[52] U.S. Cl. ..... 156/71; 156/94; 156/247; 156/344; 156/577; 273/51; 428/343

[58] Field of Search ..... 156/71, 94, 522, 523, 156/524, 526, 527, 574, 577, 344, 247; 273/51; 428/40, 343, 351

[56] References Cited

U.S. PATENT DOCUMENTS

| | | | |
|---|---|---|---|
| 2,898,825 | 8/1959 | Walker | 94/1.5 |
| 3,097,986 | 7/1963 | Kauer | 156/577 |
| 3,617,424 | 11/1971 | Smith | 156/577 |
| 3,765,972 | 10/1973 | Wesp | 156/71 |
| 4,075,386 | 2/1978 | Willdorf | 428/40 |
| 4,205,843 | 6/1980 | Murrey | 273/51 |
| 4,221,620 | 9/1980 | Milne | 156/71 |
| 4,221,628 | 9/1980 | Rosenberg et al. | 156/577 |
| 4,244,570 | 1/1981 | Murrey, Sr. | 273/51 |
| 4,307,883 | 12/1981 | Kelly | 273/51 |
| 4,337,290 | 6/1982 | Kelly | 428/201 |
| 4,406,456 | 9/1983 | Berry | 273/51 |
| 4,409,287 | 10/1983 | Harrison | 428/343 |
| 4,496,628 | 1/1985 | Deatcher et al. | 428/40 |
| 4,499,130 | 2/1985 | Questel et al. | 428/343 |
| 4,552,792 | 11/1985 | Julian et al. | 428/40 |
| 4,591,525 | 5/1986 | Cass | 428/195 |

*Primary Examiner*—Michael Wityshyn

*Attorney, Agent, or Firm*—Kenyon & Kenyon

[57] ABSTRACT

A flexible layer of material is extended over a bowling lane surface and adhered thereto. The flexible layer is preferably an adhesive backed material which may be either transparent or opaque, as preferred. The flexible material is preferably provided in a roll of a width corresponding to the width of a bowling lane so that no trimming is necessary after the material is applied.

12 Claims, 1 Drawing Sheet

BOWLING LANE REFINISHING METHOD

This application is a continuation, of application Ser. No. 871,318, filed 6 June 1986, now abandoned.

BACKGROUND OF THE INVENTION

The present invention is directed generally to an apparatus and method for quickly and easily refinishing a smooth flat surface subject to wear and more particularly to an apparatus and method for refinishing a bowling lane.

Effective maintenance of modern bowling lanes conventionally entails resanding of the wood lane surface every other year together with applying a liquid finish coat onto the resanded surface. In the off years between sandings, additional liquid finish might be applied to the lanes where needed.

This annual refinishing generally represents a substantial expense for the bowling lane operator. Because special equipment and materials are required and uniformity in the thickness of the applied top coating is very important, such refininishing is generally beyond the capability of regular bowling lane attendants and maintenance personnel. Independent professionals are generally employed for this service.

In addition to the expense, the conventional sanding and refinishing operations are time consuming and generally require the lanes being worked on to be taken out of service for at least several days.

Another disadvantage of conventional bowling lane refinishing is the practical impossibility of applying a perfectly uniform finish coat even if done by a professional. Finally, the periodic resanding will eventually cause the lane surface to be worn down to the point where the nails securing the lane bed boards together become exposed, at which point the lane is generally rendered inoperative so as to require replacement.

Accordingly, a primary object of the invention is to provide an improved apparatus and method for refinishing a flat surface subject to wear.

Another object of the invention is to provide an improved bowling lane refinishing apparatus and method.

Another object is to provide an apparatus and method for quickly and easily applying a replacement finish of uniform thickness onto a bowling lane.

Another object is to provide a bowling lane refinishing apparatus and method wherein a relatively thick replaceable base coat may be applied onto the lane.

Another object is to provide an improved bowling lane reinishing apparatus and method wherein a thin top coat layer may be simply rolled onto the exposed surface of the bowling lane.

Finally, another object of the invention is to provide a bowling lane refinishing apparatus and method which are inexpensive and efficient and which afford a rugged uniform top surface.

SUMMARY OF THE INVENTION

Resurfacing or refinishing a bowling lane is substantially simplified according to the present invention wherein a flexible layer of material is unrolled onto the bowling lane surface and securely adhered thereto. The flexible layer is preferrably an adhesive backed material so that no separate step of applying the adhesive is required. Likewise, the roll of flexible material is provided in a width corresponding to the width of the bowling lane so that a single strip of the material covers the lane and no trimming of the lateral edges is required except on narrow lanes under 42 inches wide.

A relatively thick layer may be applied as the base coat or a relatively thin layer may be applied in the same manner as a finish topcoat. In either instance, the applied layer of material may either be transparent to expose the natural beauty of the wood surface or be opaque with a printed pattern to cover old worn surfaces.

DESCRIPTION OF THE PREFERRED EMBODIMENT

Figure 1:
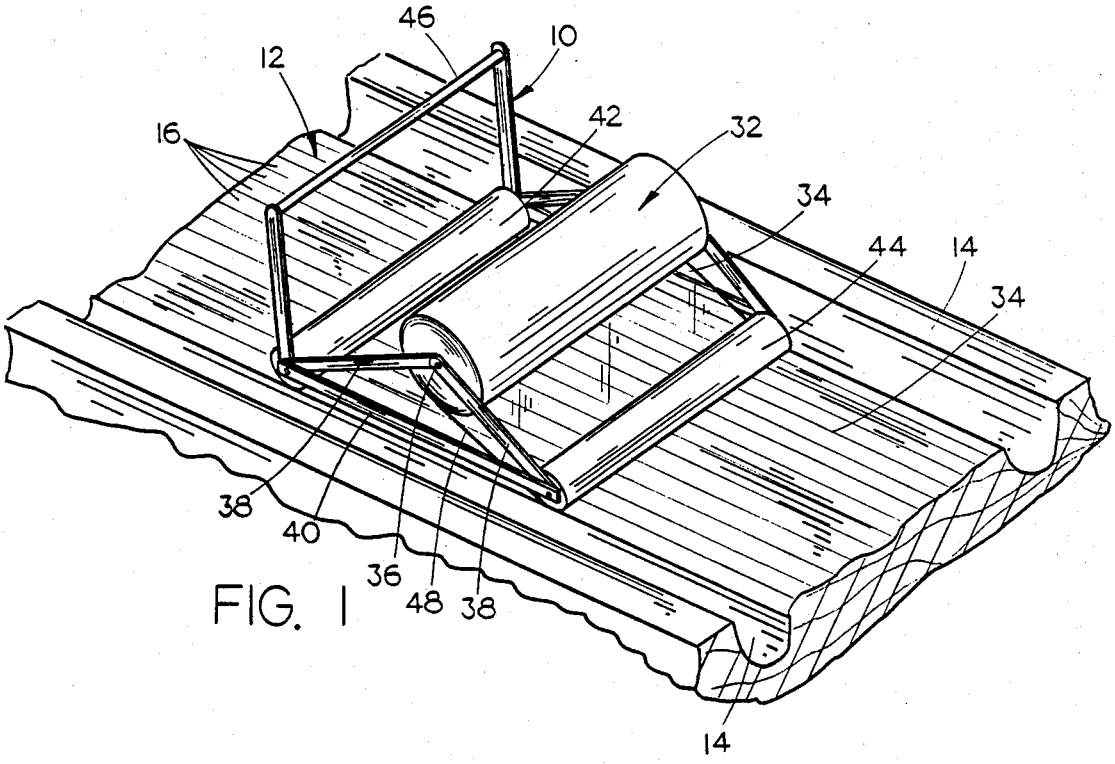
FIG. 1 is a foreshortened partial perspective view of a bowling lane with a roll of an adhesive backed topcoat material being supported on an applicator apparatus and being applied to the lane surface.

FIG. 1 illustrates a tape applicator apparatus 10 supported on a conventional wood bowling lane 12 that is situated between a pair of parallel spaced apart gutters 14. Where the conventional bowling lane is 42" wide, it has a top surface formed by a plurality of interconnected wood leveling strips 16. Each strip has an oppositely facing tongue 18 and a groove 20 for a precise nested fit with adjacent strips. Nails 22 secure the leveling strips together.

Figure 2:
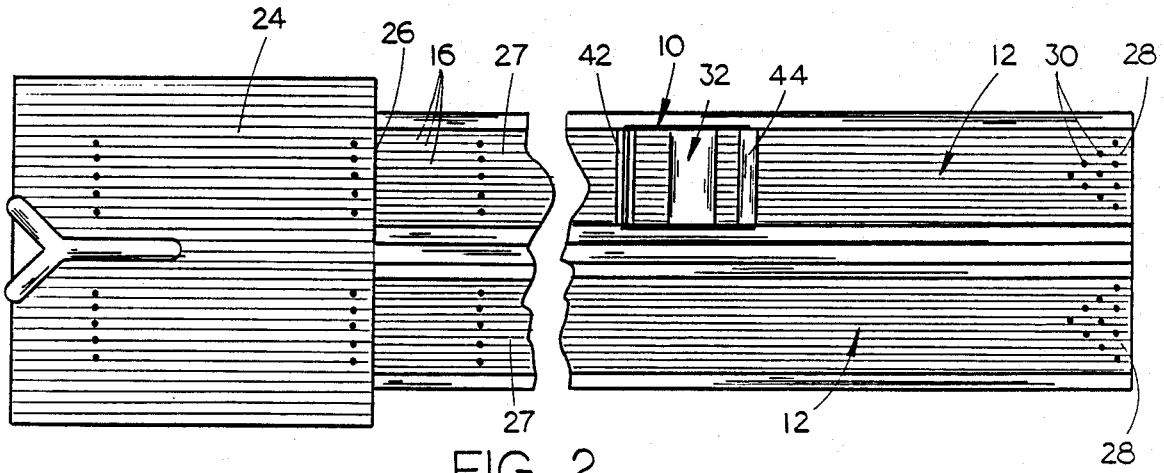
FIG. 2 is a foreshortened top plan view of a pair of bowling lanes including the refinishing tape applicator apparatus on one lane thereof.

Referring to FIG. 2, the conventional bowling lane furthermore includes an elongated approach area 24, which terminates at the foul line 26 which marks the one end of the lane. The first 16 feet of lane extending from the foul line is referred to as the "headers" and includes the lane markings designatig various transverse positions on the lane. At the opposite end of the lane, pins are adapted to be set up on what is referred to as the "pin deck" in a pattern as indicated by the markings 30. Whereas the headers 27 are generally formed of a hard maple wood, the remainder of the lane may be formed of a softer pine.

The present invention is directed to a novel coating for a the bowling lane, which coating is provided as a roll 32 of flexible material. "Flexible" is here used to describe the bendability of the tape but is not intended to imply any degree of stretchability. It is preferred that the material be as stretch resistant as possible and that it be resistant to both impact and wear.

The flexible material 34 is preferably provided as a roll of adhesive backed transparent tape. The tape roll may be supported on apparatus 10 on a cross shaft 36 carried by a pair of support arms 38 which converge upwardly from a frame side member 40 which extends between front and rear rollers 42 and 44. A raised handle structure 46 facilitates movement of the apparatus 10 along the bowling lane 12.

In operation, a roll 32 of the transparent coating material is rotatably supported on apparatus 10 and the apparatus is positioned adjacent to one end of the bowling lane 12. The tape is pulled downwardly, transversely aligned with the lane 12 and pressed against the lane. Thereafter, it is only necessary to advance the apparatus 12 along the length of the lane whereby the transparent tape or flexible material 34 is unrolled with the adhesive side 48 facing downwardly so that it can be pressed against the lane's surface by a rear roller 44.

Whereas the tape applicator apparatus 10 is believed to greatly facilitate the application of the flexible material 34 onto the lane 12, it is contemplated that the flexible material could simply be manually unrolled on to the lane's surface without any apparatus. The tape is preferably of a width to exactly conform to the width of the bowling lane so that it covers the entire lane without any need for trimming any excess. The tape may be unrolled along the full extent of the lane in a single strip or headers may be covered with a different type of tape than that which is extended from the headers to the pin deck. For example, it may be desirable to provide the headers with tape having means for facilitating sliding movement of a bowling ball on the flexible layer 34. This can be accomplished either by a very light oil finish or by forming the tape of a material impregnated with silicone or the like.

Figure 3:
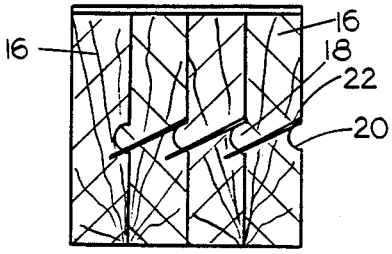
FIG. 3 is an enlarged cross-sectional view of a portion of a bowling lane, including a relatively thick base coat applied to the top surface thereof.
Figure 4:
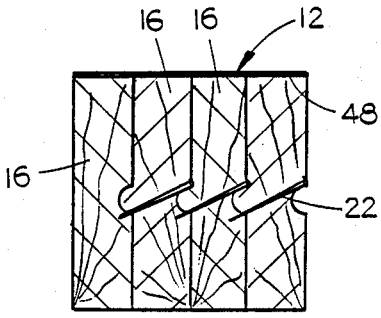
FIG. 4 is an enlarged sectional view of a bowling lane showing a relatively thin base coat applied to the top surface thereof.

Furthermore, the flexible material 34 may be applied as a relatively thin top coat, as shown in FIG. 4, having a thickness on the order of 3–4 mils or as a substantially thicker protective base coat, as illustrated in FIG. 3. Whereas, a transparent tape is desirable for exposing the natural beauty of the wood lane, it may be desirable to cover a damaged or repaired lane surface with a flexible material 34, which is opaque and exhibits a photographic top surface resembling a natural wood pattern and possibly including all of the conventional bowling lane markings.

Whereas, the adhesive backed flexible material is preferred for ease of application, it is contemplated that the adhesive could be independently applied to the flexible material or to the lane's surface prior to applying a plain flexible material thereto. An adhesive dispenser and roller applicator could be mounted on the apparatus 10 for uniformly applying the adhesive to the underside of the flexible material or directly to the lane in response to advancing movements of the apparatus.

When it is desired to replace the top coat tape 34, the previous coat can preferably be stripped from the lane easily by simply raising a corner, then one end and then pulling the entire tape off the lane.

It will be appreciated that the apparatus and method disclosed herein will find application on other surfaces than bowling lanes. The tapelike top coat of the invention would be a natural for finishing a shuffleboard surface. This type of surface treatment would also be ideal for high traffic areas such as in airports and commercial building hallways.

The tapelike top coat of the invention simplifies the maintenance of surfaces subject to wear and assures a finished top coat of a uniform thickness and material characteristics. Thus, there has been shown and described a bowling lane refinishing apparatus and method which accomplish at least all of the stated objects.

I claim:

1. A method of refinishing an existing wood top surface of a bowling lane formed by a plurality of interconnected wood leveling strips extending between spaced-apart gutters from a foul line adjoining an approach area to and including a pin deck on which bowling pins are to be set up, the method comprising, providing an adhesive material and a roll of a preformed flexible transparent tape having top and bottom surfaces, unrolling said roll of said flexible tape onto the top surface of the bowling lane to cover at least a substantial portion of the length of the lane, and causing said adhesive material to be interposed between the bottom surface of said flexible tape and the existing wood top surface of the lane, said adhesive being capable of securely adhering said flexible transparent tape onto the top surface of the lane.

2. The method of claim 1 wherein said adhesive material and roll of a preformed flexible transparent tape are provided together as a roll of an adhesive-baked tape.

3. The method of claim 1 wherein said causing step comprises applying said adhesive to the bottom surface of said preformed flexible transparent tape while unrolling said roll of the flexible transparent tape onto the bowling lane.

4. The method of claim 1 wherein said causing step comprises applying said adhesive to the existing wood top surface of the bowling lane prior to unrolling said roll of the preformed flexible transparent tape onto the bowling lane.

5. The method of claim 1 wherein providing said roll of a preformed flexible transparent tape further comprises providing said roll with a width substantially conforming to the width of the bowling lane.

6. The method of claim 1 wherein said unrolling step further comprises providing a roll dispensing apparatus including at least one applicator roller, supporting said roll of said preformed flexible transparent tape on said apparatus, simultaneously unrolling said roll of the flexible transparent tape in response to advancing movement of the apparatus along the bowling lane, and pressing said roller against the top surface of the unrolled flexible transparent tape to securely adhere it to the wood top surface of the bowling lane.

7. The method of claim 1 wherein said providing step includes providing a preformed flexible transparent tape having a thickness on the order of 3–4 mils.

8. A method of refinishing a top surface of a wood strip bowling lane having a width extending between spaced apart gutters and a length extending from a foul line to at least a pin deck, the method comprising:

unrolling a roll of preformed adhesive-backed flexible transparent tape along the length of the lane onto the top surface of the wood strips with the adhesive side down, the tape having a width substantially equal to the width of the lane, and pressing the flexible transparent tape against the lane to securely adhere the tape to the wood top surface of the lane.

9. The method of claim 8 wherein the flexible transparent tape has a thickness on the order of 3–4 mils.

10. The method of claim 8 wherein the step of pressing the tape against the lane comprises pressing the tape against the surface of the lane with a roller.

11. The method of claim 8 further comprising the step of subsequently removing the transparent tape by raising one corner, then one end, and then pulling the entire tape off the lane.

12. A method of refinishing a top surface of a wood strip bowling lane having a width extending between spaced apart gutters and a length extending from a foul line to at least a pin deck, the method comprising:

rotatably supporting a roll of adhesive backed flexible transparent tape on a frame provided with a roller, the widths of the tape and the roller being approx-iamtely equal to the width of the bowling lane;

pulling an end of the tape from the roll;

aligning the end of the tape transversely with the lane at one end of the lane, with the adhesive side of the tape facing downwardly;

moving the frame toward the other end of the lane such that the roller presses the tape against the wood top surface of the lane to securely adhere the tape to the lane.

* * * * *

UNITED STATES PATENT AND TRADEMARK OFFICE

CERTIFICATE OF CORRECTION

PATENT NO. : 4,867,816

DATED : 19 September 1989

INVENTOR(S) : SUITER James R.

It is certified that error appears in the above-identified patent and that said Letters Patent is hereby corrected as shown below:

Column 1, line 51: change "reinishing" to --refinishing--.

Column 2, line 42: change "designatig" to --designating--.

Column 4, line 15: change "baked" to --backed--.

Signed and Sealed this

Twenty-sixth Day of February, 1991

*Attest:*

HARRY F. MANBECK, JR.

*Attesting Officer*

*Commissioner of Patents and Trademarks*